US006607042B2

(12) United States Patent
Hoyer et al.

(10) Patent No.: US 6,607,042 B2
(45) Date of Patent: Aug. 19, 2003

(54) METHOD OF DYNAMICALLY CONTROLLING BOTTOM HOLE CIRCULATION PRESSURE IN A WELLBORE

(75) Inventors: Carel W. J. Hoyer, Calgary (CA); Robert A. Graham, Norwich (GB); Adrian Steiner, Calgary (CA)

(73) Assignee: Precision Drilling Technology Services Group Inc. (CA)

( * ) Notice: Subject to any disclaimer, the term of this patent is extended or adjusted under 35 U.S.C. 154(b) by 0 days.

(21) Appl. No.: 09/858,954

(22) Filed: May 17, 2001

(65) Prior Publication Data

US 2002/0170749 A1 Nov. 21, 2002

(30) Foreign Application Priority Data

Apr. 18, 2001 (CA) ..... 2344627

(51) Int. Cl.[7] ..... E21B 7/00
(52) U.S. Cl. ..... 175/38; 175/48
(58) Field of Search ..... 175/38, 48, 65, 175/320

(56) References Cited

U.S. PATENT DOCUMENTS

| | | | | |
|---|---|---|---|---|
| 3,497,020 A | | 2/1970 | Kammerer | |
| 3,747,698 A | | 7/1973 | Chapman | |
| 3,786,878 A | | 1/1974 | Chapman | |
| 3,970,335 A | | 7/1976 | Curington et al. | |
| 4,243,252 A | | 1/1981 | Johnson | |
| 4,718,503 A | * | 1/1988 | Stewart | 175/70 |
| 5,355,967 A | | 10/1994 | Mueller et al. | |
| 5,720,356 A | | 2/1998 | Gardes | |
| 5,865,261 A | | 2/1999 | Cooper et al. | |
| 5,873,420 A | | 2/1999 | Gearhart | |
| 6,065,550 A | | 5/2000 | Gardes | |
| 6,367,566 B1 | * | 4/2002 | Hill | 175/57 |
| 6,457,540 B2 | | 10/2002 | Gardes | 175/62 |
| 2002/0007968 A1 | * | 1/2002 | Gardes | 175/57 |
| 2002/0011338 A1 | * | 1/2002 | Maurer et al. | 166/372 |
| 2002/0117332 A1 | * | 8/2002 | Dawson et al. | 175/5 |

OTHER PUBLICATIONS

International Search Report, PCT/CA02/00484, Jun. 27, 2002.

UK Patent Application, No.2323870, Oct. 7, 1998.

PCT Published Application No. WO 99/49172, Sep. 30, 1999.

PCT Published Application No. WO 00/75477, Dec. 14, 2000.

PCT Published Application No. WO 00/4269, Jan. 27, 2000.

PCT Published Application No. WO 99/42696, Aug. 26, 1999.

* cited by examiner

*Primary Examiner*—William Neuder
(74) *Attorney, Agent, or Firm*—Merek, Blackmon & Voorhees, LLC

(57) ABSTRACT

A method of drilling a well having a first tubular member extending from the surface of the well to a position proximate the bottom of the well. The first tubular member has an inner annulus therethrough. A fluid is pumped into the well through the inner annulus of the first tubular member to flush drilling cuttings out of the well. A fluid is also injected into the well, exterior to the inner annulus, to control the bottom hole circulating pressure in the well.

20 Claims, 7 Drawing Sheets

METHOD OF DYNAMICALLY CONTROLLING BOTTOM HOLE CIRCULATION PRESSURE IN A WELLBORE

FIELD OF THE INVENTION

This invention relates to a method of controlling downhole pressure while drilling through underground formations, and in particular to a method of dynamically controlling the bottom hole circulating pressure in a wellbore passing through a high pressure underground formation. One specific aspect of the invention relates to the drilling of high pressure underground hydrocarbon formations, such as high pressure gas and oil wells.

BACKGROUND OF THE INVENTION

A common method of drilling wells from the surface through underground formations employs the use of a drill bit that is rotated by means of a downhole motor (sometimes referred to as a mud motor), through rotation of a drill string from the surface, or through a combination of both surface and downhole drive means. Where a downhole motor is utilized, typically energy is transferred from the surface to the downhole motor through pumping a drilling fluid or "mud" down through a drill string and channeling the fluid through the motor in order to cause the rotor of the downhole motor to rotate and drive the rotary drill bit. The drilling fluid or mud serves the further function of entraining drill cuttings and circulating them to the surface for removal from the wellbore. In some instances the drilling fluid may also help to lubricate and cool the downhole drilling components.

When drilling for oil and gas there are many instances where the underground formations that are encountered contain hydrocarbons that are subjected to very high pressures. Traditionally, when drilling into such formations a high density drilling fluid or mud is utilized in order to provide a high hydrostatic pressure within the wellbore to counteract the high pressure of the hydrocarbons in the formation below. In such cases the high density of the column of drilling mud exerts a hydrostatic pressure upon the below ground formation that meets or exceeds the underground hydrocarbon pressure thereby preventing a potential blowout which may otherwise occur. Where the hydrostatic pressure of the drilling mud is approximately the same as the underground hydrocarbon pressure, a state of balanced drilling is achieved. However, due to the potential danger of a blowout in high pressure wells, in most instances an overbalanced situation is desired where the hydrostatic head of the drilling mud exceeds the underground hydrocarbon pressure by a predetermined safety factor. The high density mud and the high hydrostatic head that it creates also helps prevent a blowout in the event that a sudden fluid influx or "kick" is experienced when drilling through a particular aspect of an underground formation that is under very high pressure, or when first entering a high pressure zone.

Unfortunately, such prior systems that employ high density drilling muds to counterbalance the effects of high pressure underground hydrocarbon deposits have met with only limited success. In order to create a sufficient hydrostatic head in many instances the density of the drilling muds has to be relatively high (for example from 15 to 25 pounds per gallon) necessitating the use of costly density enhancing additives. Such additives not only significantly increase the cost of the drilling operations, but can also present environmental difficulties in terms of their handling and disposal.

High density muds are also generally not compatible with many 4-phase surface separation systems that are designed to separate gases, liquids and solids. In typical surface separation systems the high density solids are removed preferentially to the drilled solids and the mud must be re-weighted to ensure that the desired density is maintained before it can be pumped back into the well.

High density drilling muds also present an increased potential for plugging downhole components, particularly where the drilling operation is unintentionally suspended due to mechanical failure. Further, the expense associated with costly high density muds is often increased through their loss into the underground formation. Often the high hydrostatic pressure created by the column of drilling mud in the string results in a portion of the mud being driven into the formation requiring additional fresh mud to be continually added at the surface. Invasion of the drilling mud into the subsurface formation may also cause damage to the formation.

A further limitation of such prior systems involves the degree and level of control that may be exercised over the well. The hydrostatic pressure applied to the bottom of the wellbore is primarily a function of the density of the mud and the depth of the well. For that reason there is only a limited ability to alter the hydrostatic pressure applied to the formation when using high density drilling muds. Generally, varying the hydrostatic pressure requires an alteration of either the density of the drilling mud or the surface backpressure, both of which can be a difficult and time consuming process.

SUMMARY OF THE INVENTION

The invention therefore provides a method of dynamically controlling the bottom hole pressure in a high pressure well that addresses a number of limitations in the prior art. In particular, the method of the present invention provides a means to alter and control bottom hole pressure without the need for the utilization of high density, expensive, drilling muds, while also providing a simpler and more time responsive manner to control downhole pressures to react to changing downhole drilling environments.

Accordingly, in one of its aspects the invention provides a method of drilling a well through an underground formation, the method comprising the steps of: with a drill bit drilling a borehole from a location near the surface into the earth; using a first string to define an inner annulus within said borehole, said inner annulus running from the surface to a point proximate the bottom of said borehole; positioning a second string within the borehole about said first string and thereby defining a second annulus between the interior of said second string and the exterior of said first string, thereby also defining an outer annulus exterior to said second string; providing a connecting passageway between said outer annulus and said second annulus at a point uphole from the bottom of said first string, said outer annulus sealed at a point downhole of said connecting passageway such that fluid entering said outer annulus is prevented from escaping into the bottom of the well and is directed through said connecting passageway; providing a supply of pressurized drilling fluid to the drill bit by pumping said drilling fluid through said inner annulus, said drilling fluid flushing cuttings produced by said drill bit through said second annulus and exiting out of said well in the form of drilling fluid returns; and, providing a supply of pressurized fluid to said second annulus by pumping said fluid into said outer annulus and forcing said fluid into said second annulus through said connecting passageway, said fluid forced into said second annulus increasing the friction of said returns flowing through said second annulus resulting in an increase in friction pressure within said second annulus and thereby increasing the bottom hole circulating pressure in the well.

In a further aspect the invention provides a method of drilling an encased well into a high pressure underground hydrocarbon formation utilizing a drill bit drilling a borehole from a location near the surface into the underground formation, the method comprising the steps of: with a first string situated within the borehole, defining an inner annulus running from the surface to a point proximate the bottom of the borehole; placing a second string within the borehole about said first string thereby defining a second annulus between the interior of said second string and the exterior of said first string, thereby also defining an outer annulus between the exterior of said second string and the interior of the well casing; providing a connecting passageway between said outer annulus and said second annulus at a point uphole from the bottom of said first string; providing a supply of pressurized drilling fluid to the drill bit by pumping said drilling fluid through said inner annulus, said drilling fluid flushing cuttings produced by said drill bit through said second annulus, said drilling fluid and said cuttings in said second annulus comprising drilling fluid returns; providing a supply of pressurized fluid to said second annulus by pumping said fluid into said outer annulus and forcing said fluid into said second annulus through said connecting passageway; and, maintaining the bottom hole circulating pressure in the well within defined limits through monitoring the pressure of said returns within said second annulus and controlling the volume and pressure of fluid pumped into said outer annulus in response to fluctuations in the pressure of said returns in said second annulus.

In yet a further embodiment the invention provides a method of drilling an encased well into a high pressure underground hydrocarbon formation utilizing a drill bit to drill a borehole from a location near the surface into the underground formation, the method comprising the steps of: with a first string situated within the borehole, defining an inner annulus running from the surface to a point proximate the bottom of the borehole; placing a second string within the borehole about said first string thereby defining a second annulus between the interior of said second string and the exterior of said first string, thereby also defining an outer annulus between the exterior of said second string and the interior of the well casing; providing a connecting passageway between said outer annulus and said second annulus at a point uphole from the bottom of said first string; providing a supply of pressurized drilling fluid to the drill bit by pumping said drilling fluid through said inner annulus, said drilling fluid flushing cuttings produced by said drill bit through said second annulus, said drilling fluid and said cuttings in said second annulus comprising drilling fluid returns; providing a supply of pressurized fluid to said second annulus by pumping said fluid into said outer annulus and forcing said fluid into said second annulus through said connecting passageway; and, maintaining the bottom hole circulating pressure in the well within defined limits through monitoring the downhole fluid pressure proximate the bottom of the well and controlling the volume and pressure of fluid pumped into said outer annulus in response to fluctuations in the downhole fluid pressure.

In still a further embodiment the invention provides a method of controlling the bottom hole circulating pressure when drilling an encased well through a pressurized underground formation where a supply of pressurized drilling fluid is pumped down an inner annulus in a drill string and released into the bottom of the well to entrain cuttings and flush the cuttings from the well through an outer annulus defined by the exterior of the drill string and the interior of the well casing, the method comprising designing and constructing the drilling system, said drilling system including the drilling fluid, the drill string and the well casing, such that there is sufficient friction pressure generated in said outer annulus when said drilling fluid and said cuttings pass therethrough to create sufficient fluid back pressure at the bottom of the well and to thereby maintain the bottom hole circulating pressure within a desired range for a predetermined drilling fluid flow rate.

The invention also provides a method of drilling a well having a first tubular member extending from the surface of said well to a position proximate the bottom of said well, said first tubular member having an inner annulus, said well also having a second tubular member extending from the surface of said well to a position proximate the bottom of said well, said first and second tubular members forming a second annulus therebetween, said second tubular member and said well forming an outer annulus therebetween, said method comprising pumping a fluid through said inner annulus; and, pumping a fluid through said outer annulus and into said second annulus to control the circulating pressure while drilling said well.

In addition, the invention provides a method of controlling the bottom hole circulating pressure when drilling a well having first and second tubular members extending from the surface of said well to positions proximate the bottom of said well, at least a substantial portion of said first tubular member received within said second tubular member, said first tubular member defining an inner annulus, a second annulus formed between said first and said second tubular members, and an outer annulus formed between said second tubular member and said well, said outer annulus and said second annulus connected by at least one connecting passageway, the method comprising the steps of pumping a fluid into said well through said inner annulus, said fluid flushing drilling cuttings through said second annulus and out of said well; and, pumping a fluid through said outer annulus and through said connecting passageway into said second annulus to control the bottom hole circulating pressure while drilling said well.

In a further aspect the invention provides a method of controlling the bottom hole circulating pressure when drilling a well having first and second tubular members extending from the surface into said well, said well having an inner annulus defined by the interior of said first tubular member, said well having a second annulus defined by the outer surfaces of said first and said second tubular members and the inner surface of said well, said well having an outer annulus defined by the interior of said second tubular member, the method comprising the steps of pumping a fluid through said inner annulus in said first tubular member; and, pumping a fluid through said outer annulus in said second tubular member and into said second annulus to control the circulating pressure while drilling said well.

The invention also provides a method of controlling the bottom hole circulating pressure when drilling an encased well having a first tubular member extending from the surface into said well, said well having an inner annulus defined by the interior of said first tubular member, said well having a second annulus defined by the outer surface of said first tubular member and the inner surface of said well, said well having an outer annulus defined by the interior of a second tubular member extending from the surface along the exterior surface of the well casing, said second tubular member intersecting said well casing at a defined position along the length of said well casing and said outer annulus in communication with said second annulus adjacent said point of intersection, the method comprising the steps of pumping a fluid through said inner annulus in said first tubular member; and, pumping a fluid through said outer annulus in said second tubular member and into said second annulus to control the circulating pressure while drilling said well.

The invention still further provides a method of drilling a well having a first tubular member extending from the surface of said well to a position proximate the bottom of said well, said first tubular member having an inner annulus therethrough, said method comprising pumping a fluid into said well through said inner annulus, said fluid flushing drilling cuttings out of said well; and, injecting a fluid into said well, exterior to said inner annulus, to control the bottom hole circulating pressure in said well.

Further advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENT

The present invention may be embodied in a number of different forms. However, the specification and drawings that follow describe and disclose only some of the specific forms of the invention and are not intended to limit the scope of the invention as defined in the claims that follow herein.

Figure 1:
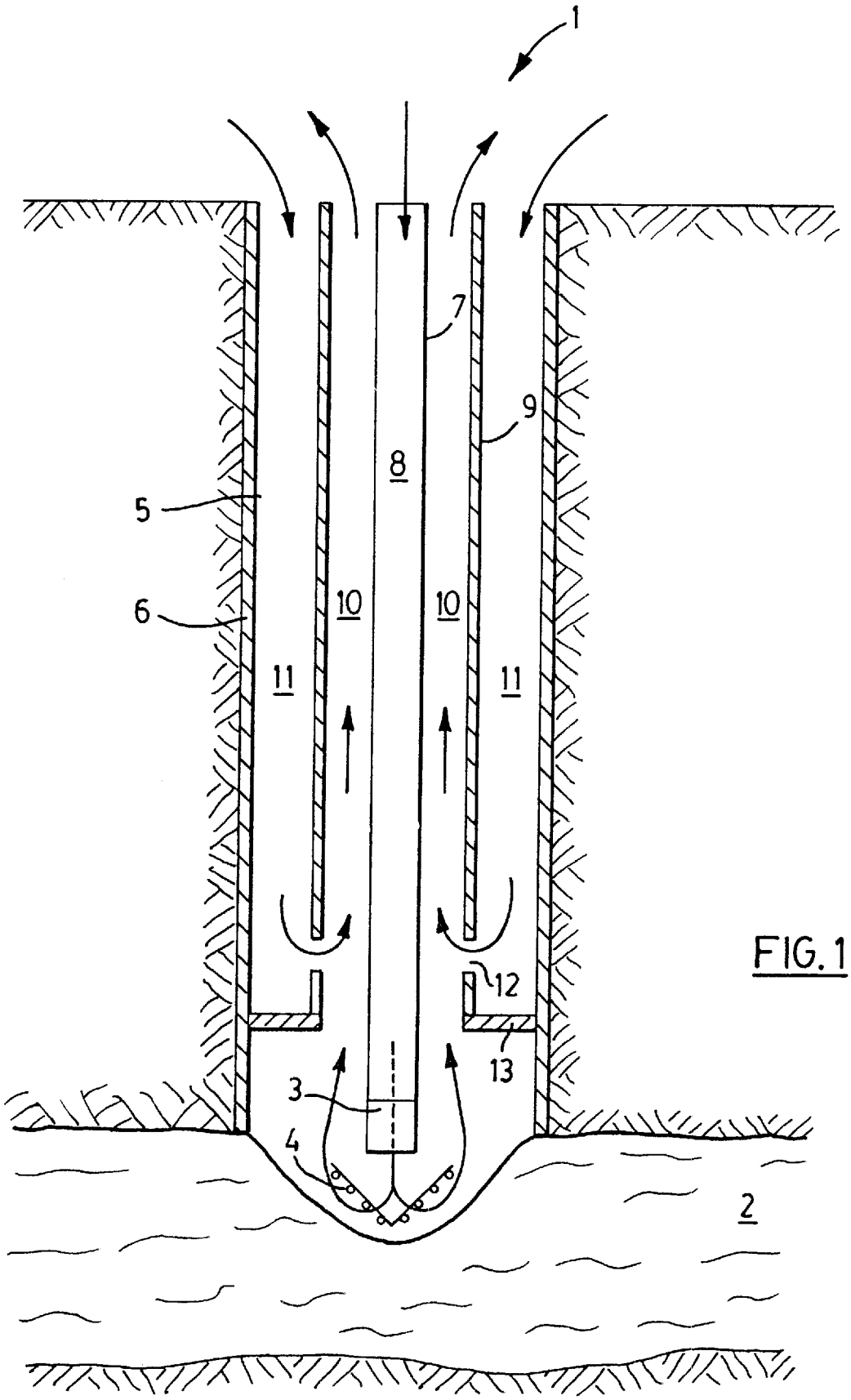
FIG. 1 is a schematic drawing showing a side sectional view of a well undergoing drilling in accordance with a preferred embodiment of the present invention.
Figure 2:
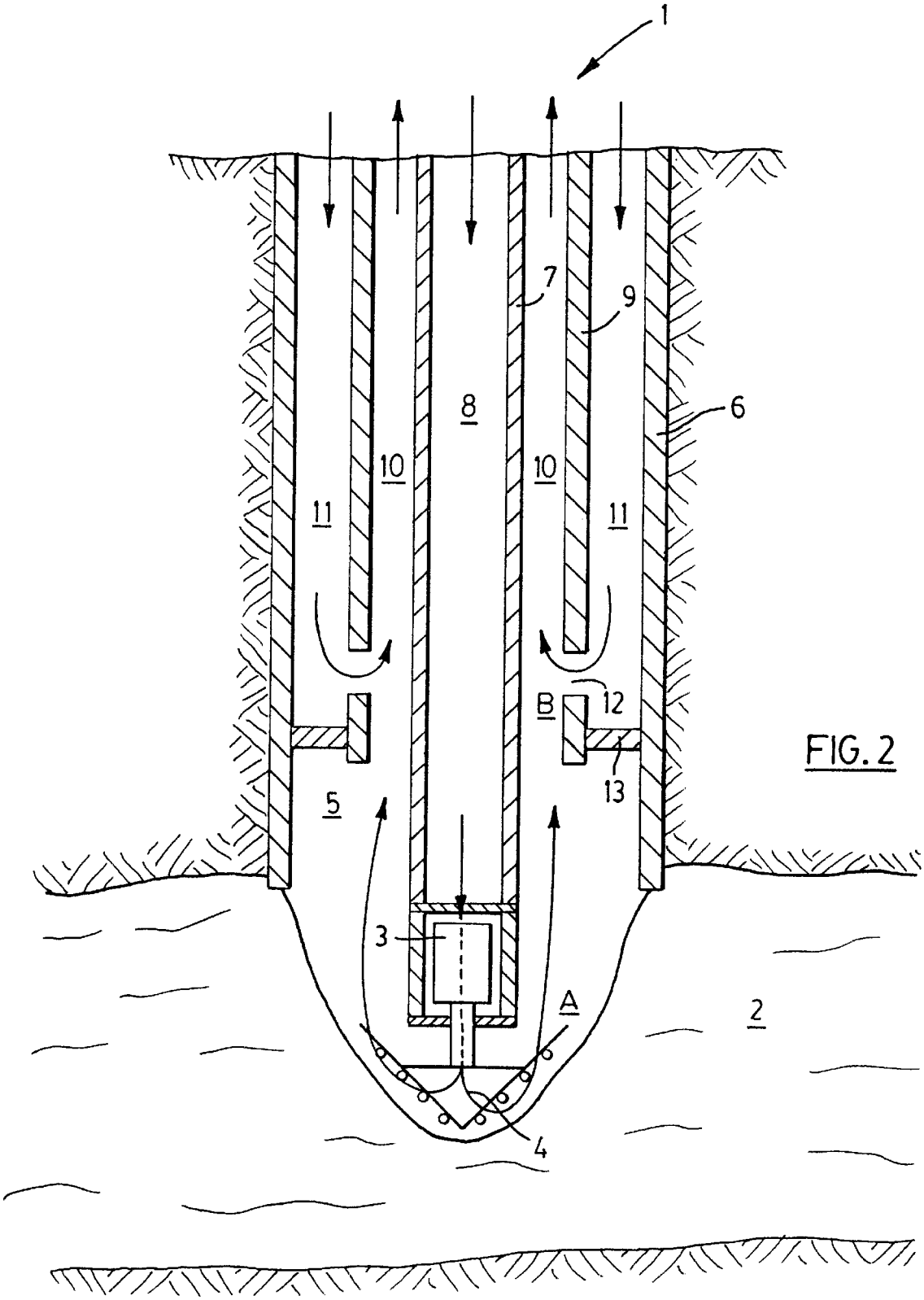
FIG. 2 is an enlarged schematic detail view of the lower end of the well shown in FIG. 1.

In FIGS. 1 and 2 there is shown by way of schematic illustration a well 1 that is in the process of being drilled by means of one of the preferred embodiments of the method encompassed within the present invention. In these Figures well 1 is being drilled into an underground formation 2 through the use of a downhole motor 3 driving a drill bit 4, which may be a rotary bit, a PDC bit, or any one of a variety of other commonly used or available bits. While the attached Figures show the drill bit being driven by a downhole motor, it will be understood that the bit may also be driven by means of rotating the drill string from the surface. It is expected that in most applications the borehole 5 of well 1 will be encased with a casing 6, however, where the integrity and structure of the underground formation permit the borehole need not necessarily be encased.

In a typical drilling operation that utilizes a downhole motor, drilling fluid is circulated from the surface to the motor in order to deliver energy to the motor causing it to drive drill bit 4. Aside from providing a means to energize the downhole motor (and in some cases performing cooling and lubricating functions) the other primary role of the drilling fluid is to entrain the cuttings produced by the drill bit and flush them from the borehole. For a given depth and a given size and composition of cuttings, a minimum drilling fluid circulation rate can be determined. That circulation rate is normally the level that is required for adequate drilling hydraulics and hole cleaning. Where the drilling fluid circulation rate drops below a minimum value, the circulation of drilling fluid and the flushing of cuttings from the well will tend to stall, potentially causing a plugging of the well or the downhole drilling components.

Traditionally where the bottom hole circulating pressure begins to drop below a desired value, the pressure is increased by increasing the density, of drilling fluids pumped through the drill string that connects the source of pressurized drilling fluid at the surface to the downhole motor. When drilling high pressure hydrocarbon formations while in a balanced or over balanced condition the use of high density drilling muds to maintain an adequate bottom hole circulating pressure carries with it a range of disadvantages, including those discussed in more detail above. There are also disadvantages with increasing the circulation of drilling fluid through the drill string.

It has been determined that as an alternative to increasing fluid density to maintain bottom hole circulating pressure, additional fluid may be injected into the annular stream of returns being pushed upwardly through the borehole. The effect of injecting this fluid is to increase friction pressure, and thereby increase the pressure at the bottom of the borehole causing a rise in bottom hole circulation pressure. It has also been determined that in this manner the bottom hole circulation pressure may be increased without the need to either increase the density of the drilling fluid or change the circulation rate of drilling fluid pumped down into the well through the drill string.

The above concept is further explained through an examination of the schematic representation shown in FIG. 2. In FIG. 2 there is depicted a downhole motor 3 and a drill bit 4 attached to a first string or tubular member 7 that defines an inner annulus 8 running from the surface to a point proximate the bottom of the borehole. A second string or tubular member 9 is positioned within the borehole about first string 7 to thereby define a second annulus 10 between the interior surface of the second string and the exterior surface of the first string. At the same time, there is also defined an outer annulus 11 that is exterior to second string 10. Where the borehole is encased, outer annulus 11 will be defined by the exterior surface of second string 9 and the interior surface of well casing 6. However, where no casing is used outer annulus 11 will be defined by the outer surface of second string 9 and the interior surface of the well and the formations through which it passes.

In the embodiment shown in FIG. 2, a connecting passageway 12 is located between outer annulus 11 and second annulus 10 at a point uphole from the bottom of first string 7. Passageway 12 links outer annulus 11 to second annulus 10 and provides a means for fluid to flow from the annulus 11 to annulus 10. The size and physical configuration of connecting passageway 12, as well as the number of passageways, may vary depending upon the particular operational parameters of the well in concern, and depending upon the nature of the drilling fluids that are utilized. In addition, to control the flow of fluid from annulus 11 into the well, and to prevent the potential back flow of drilling returns from second annulus 10 into outer annulus 11, connecting passageway 12 may be equipped with a one way flow device, such as a check valve or a needle valve.

Outer annulus 11 is preferably sealed or enclosed at a point downhole from connecting passageway 12 such that fluid entering outer annulus 11 is prevented from escaping down into the bottom of the well and to prevent well returns from entering annulus 11. However, it will be appreciated that under certain drilling conditions and environments the outer annulus may be left open to the wellbore. Where outer annulus 11 is sealed or enclosed fluid pumped into the annulus will be directed through connecting passageway 12. Any one of a wide variety of sealing or enclosing mechanisms or structures 13 may be utilized to seal off the lower portion of outer annulus 11. Such sealing or enclosing mechanisms may include the use of a lower liner cemented in place (see FIG. 5). Depending on whether the well is encased or not, the outer circumference of sealing mechanism 13 will be designed to either contact the well casing or the interior surface of the unencased well.

As indicated by the arrows in FIGS. 1 and 2, during drilling operations a supply of pressurized drilling fluid is provided to drill bit 4 by pumping drilling fluid from surface operations (not shown) through inner annulus 8 down to the bottom of the borehole. The drilling fluid then exits inner annulus 8 at point "A" as shown in FIG. 2. Provided there is a sufficient bottom hole circulation rate the fluid will entrain cuttings created by the drill bit and flush the cuttings up through second annulus 10 such that they exit from the well in the form of drilling fluid returns. As indicated above, and as will be discussed more thoroughly below, the bottom hole circulating pressure, and the flow of returns out of the well, is controlled through providing a supply of pressurized fluid to second annulus 10 by pumping the fluid into outer annulus 11 and forcing it into the second annulus through connecting passageway 12 (at point "B" in FIG. 2). In most instances the fluid pumped into outer annulus 11 will be the same as the drilling fluid pumped down annulus 8, however, where well conditions require the two fluids may have different compositions and different densities.

Figure 4:
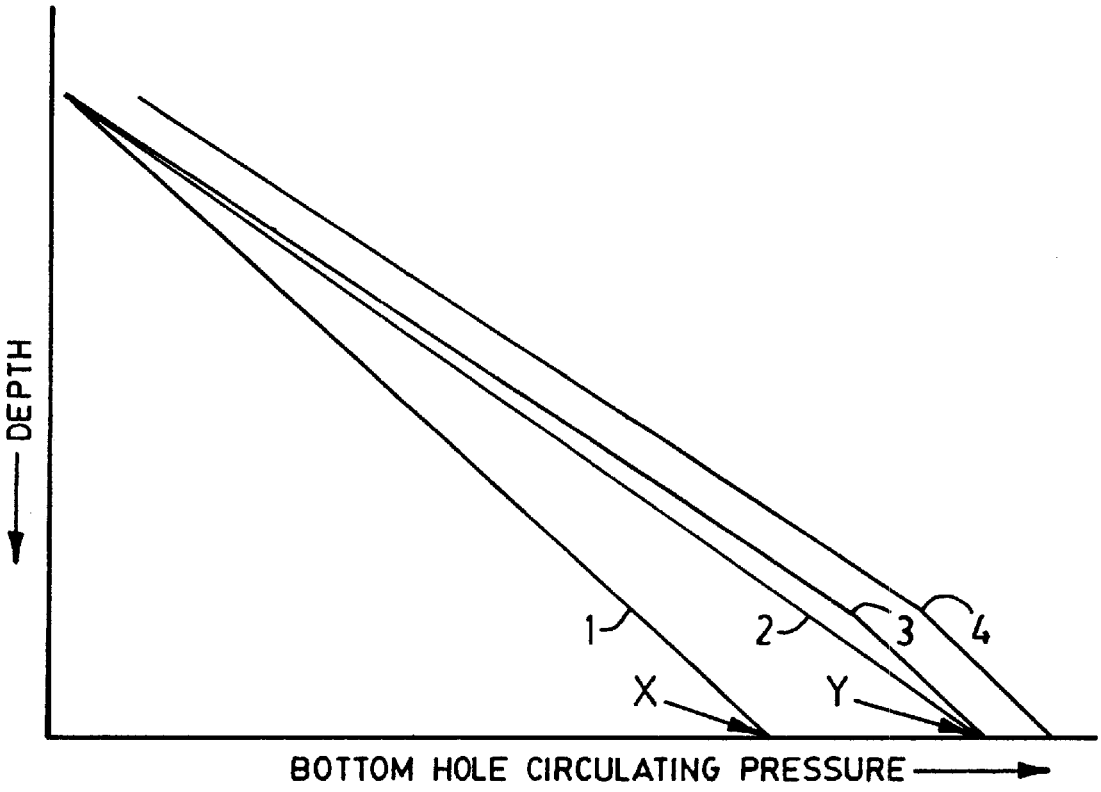
FIG. 4 is a graph that depicts bottom hole circulating pressure as a function of depth for various drilling scenarios.

To further explain the operation of the inventive method, reference will now be made to the graph that is shown in FIG. 4. In FIG. 4 normal drilling pressure circulation is represented by line "1". Line "1" indicates that as the depth of the well increases the bottom hole circulation pressure must also increase to overcome the added hydrostatic head of the returns as they exit through second annulus 10. Normal drill pipe circulation is assumed to exist where there is sufficient bottom hole circulation rate at point "A" in FIG. 2 to ensure adequate drilling hydraulics and hole cleaning. In the event that bottom hole circulation pressure drops below a desired value, under the method of the present invention rather than increasing or altering drilling fluid density, fluid is forced through connecting passageway 12 and into second annulus 10 at point "B" in FIG. 2. In FIG. 4 the increased bottom hole circulation pressure achieved through the traditional method of increasing the density of the drilling fluid or through increasing the circulation of point "A" is indicated by line "2". The increase in the bottom hole circulation pressure that is achieved through the introduction of annular fluid into second annulus 10 at point "B" is defined by line "3". Through the graphical representations in FIG. 4 it is shown that bottom hole circulation pressure can be controlled anywhere from point "X" to point "Y" by varying the circulation rate at point "B", without altering the rate of circulation at point "A" or the density of the drilling fluid.

In the event of a change in the circulation at point "A" (such as may occur during an interruption in circulation when connecting surface tubulars or during mechanical breakdown of surface equipment) the amount of fluid forced through connecting passageway 12 into second annulus 10 at point "B" can be modified in order to help maintain the desired bottom hole circulating pressure. Further bottom hole circulation pressure control can also be achieved through increasing the surface annular back pressure in second annulus 10 by restricting the outflow of the returns. The effect of doing so is shown graphically by means of line "4" in FIG. 4. However, it will be appreciated that when applying surface back pressure care must be taken not to exceed tubular burst or collapse strength. Care must also be exercised so as not to increase the risk of wellhead or blowout preventor failure.

As indicated previously, as fluid is forced through connecting passageway 12 and into second annulus 10 the effect will be to increase the friction of the returns flowing through second annulus 10 and an increase in the friction pressure within the second annulus. This increase in friction pressure in turn has the effect of increasing bottom hole circulation pressure. Accordingly, varying the flow of additional fluid into second annulus 10 allows the friction pressure within the annulus to be varied and permits the bottom hole circulating pressure to be controlled.

In one aspect of the invention the pressure of the returns within second annulus 10 is monitored. An increase in the pressure of the returns would typically indicate either an increase in the bottom hole circulating pressure and/or the onset of a "kick". Under those circumstances the friction pressure within second annulus 10 may be increased through increasing the rate of pumping of fluid into outer annulus 11 and through connecting passageway 12 into second annulus 10. Similarly, a decrease in the pressure of the returns would typically indicate a decreasing bottom hole circulating pressure and/or the passage of a "kick". Here the friction pressure within second annulus 10 may be reduced by decreasing the rate of fluid pumped into outer annulus 11.

In another aspect of the invention the downhole fluid pressure in the vicinity of the bottom of the well can be monitored to provide a "real time" indication of the bottom hole circulating pressure. As that pressure increases or decreases, the rate of circulation of fluid through connecting passageway 12 can be adjusted accordingly to keep the bottom hole circulating pressure within specified limits.

To employ the current inventive method a number of separate criteria must be considered when designed the drilling system. That is, the system and equipment operating parameters must be designed so that friction pressure in the returns can be utilized to offset the use of a lighter drilling fluid and to allow for bottom hole circulating pressure control. For example, the cross-sectional area and surface area (including the depth) of both outer annulus 11 and second annulus 10 must be known and taken into consideration in order to determine friction pressure losses. Also important will be the hydrostatic gradient of the fluid to be circulated, and the range of circulation rates achievable through first string 7. To a large extent the circulation rates will be a function of surface pumping equipment limitations, bottom hole assembly limitations, downhole motor considerations, minimum hole cleaning or flushing requirements for cutting transport, and temperature.

An additional factor to consider is the range of circulation rates achievable through second annulus 10, since that annulus must be capable of accepting drilling fluid pumped through first annulus 8, cuttings and other fluids and materials entrained within the drilling fluid from the well, and additional fluid pumped into second annulus 10 through connecting passageway 12. Once again, to a large extent the circulation rate achievable through second annulus 10 will be a function of surface pumping equipment limitations, and specifically the pressure and volume ratings of such equipment.

The maximum pressure ratings for the well should also be determined. Those ratings will be a combination of burst and collapse pressure ratings of the various tubulars involved as well as wellhead and blowout preventor equipment limitations. Finally, a knowledge and understanding of the well effluent characteristics (and in particular their rates and composition) should also be known in order that the system can be designed with an adequate safety factor to handle any expected fluid "kicks".

Since the current method is largely depended upon the control of friction pressure within second annulus 10, it will be appreciated and understood that each of the design criteria discussed above can play an integral part in the overall system design and operation. Altering one design criteria (for example the size and cross-sectional area of second string 9) may have an effect on a variety of other factors and may alter friction pressure and/or bottom hole circulating pressure. Proper overall system design keeping the above criteria and considerations in mind will therefore be important to ensure optimum performance.

Figure 3:
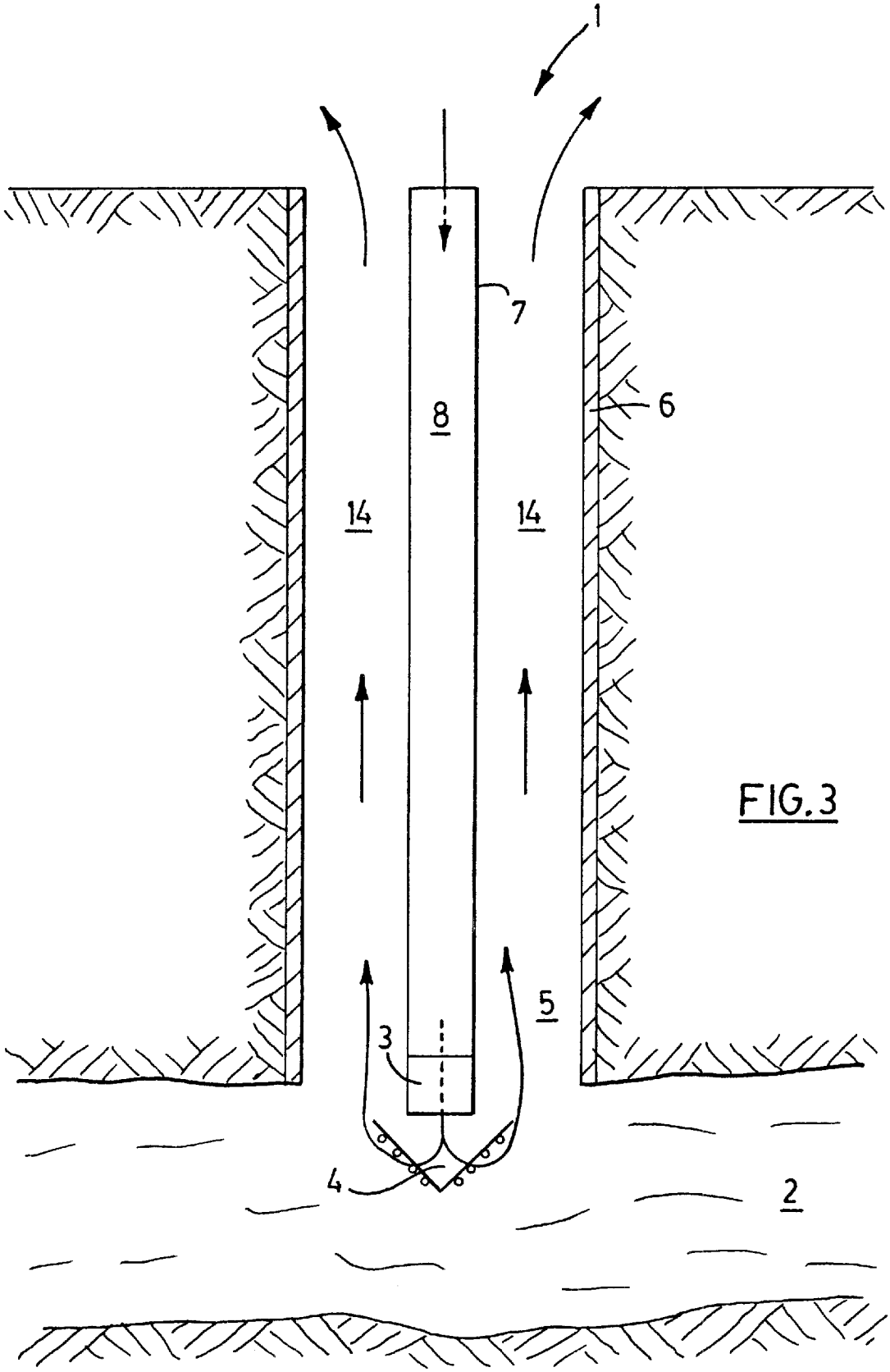
FIG. 3 is a schematic side sectional view of a well undergoing drilling in accordance an alternate embodiment of the present invention.

An alternate embodiment of the inventive method is shown schematically in FIG. 3. FIG. 3 represents a simple monobore where drilling fluid is circulated through first string 7 to the bottom of borehole 5 in order to generate the required bottom hole circulating pressure. The bottom hole circulating pressure is maintained at necessary levels through a combination of the hydrostatic pressure of the column of drilling fluid in first string 7, and the friction pressure that is developed in annulus 14 defined by the inner surface of the well casing and the outer surface of first drilling string 7. That is, the desired bottom hole circulating pressure in the embodiment shown in FIG. 3 is maintained largely by designing the system (including first string 7 and casing 6) such that the friction pressure within annulus 14 is sufficient to maintain the bottom hole circulating pressure within a desired range for a predetermined drilling fluid flow rate. The embodiment shown in FIG. 3 is expected to be most useful in coiled tubing drilling operations where there is continuous circulation, or for drilling short sections of open hole where no interruptions in circulation will be required (ie: where no tubular connections are necessary).

Figure 5:
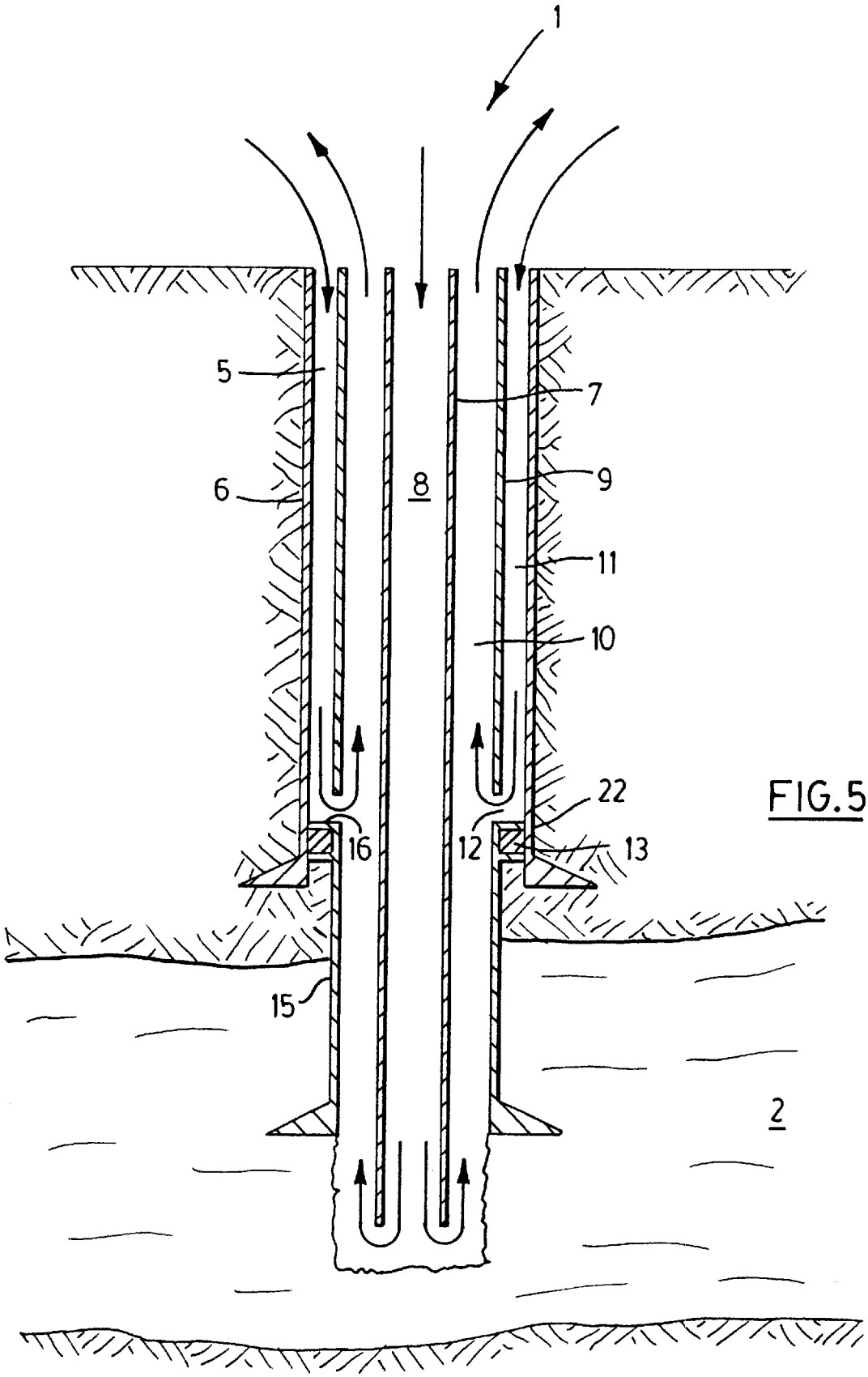
FIG. 5 is a schematic side sectional view of a well undergoing drilling in accordance with a further embodiment of the present invention.

FIG. 5 represents yet a further embodiment of the method according to the present invention. In FIG. 5 the borehole is lined with a well casing 6 for part of its length. Extending below the lower end of well casing 6 is a liner member 15 having a reduced diameter. Liner 15 would typically be cemented in place within the borehole or, alternatively, may be held in place through the use of mechanical anchors or fastening means. In the embodiment shown in FIG. 5 second string or tubular member 9 terminates at a point slightly above the upper end 16 of liner 15 such that connecting passageway 12 between outer annulus 11 and second annulus 10 is formed between the lower end of second string 9 and upper end 16 of liner 15. Here the sealing mechanism or structure 13 that seals or encloses the lower portion of outer annulus 11 comprises upper end 16 of liner 15 and/or a radial flange 22 that spans well casing 6 and liner number 15. For simplified illustration purposes neither downhole motor 3 nor drill bit 4 have been shown in FIG. 5.

Figure 6:
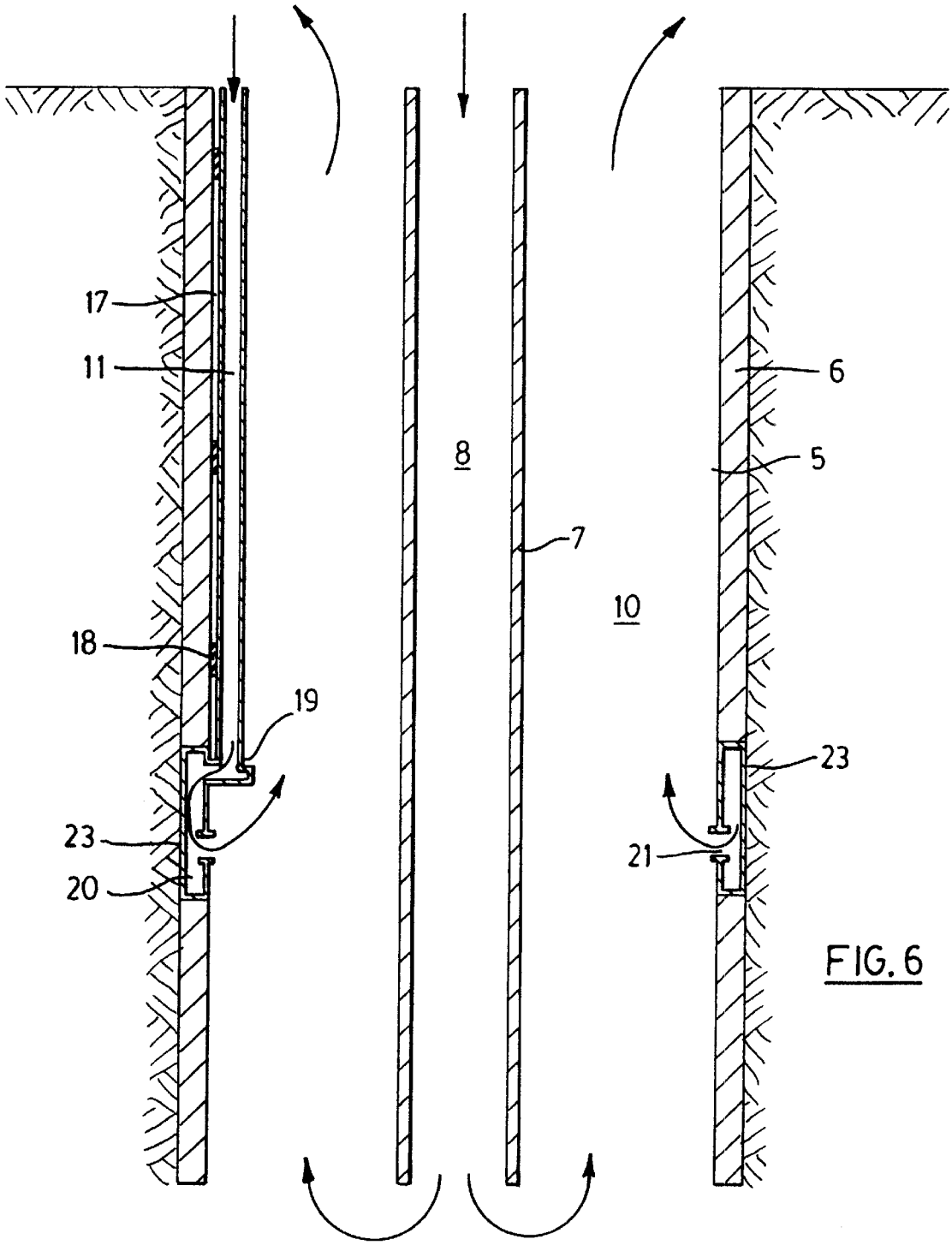
FIG. 6 is a schematic side sectional view of a well undergoing drilling in accordance with yet a further alternate embodiment of the present invention; and, FIG. 7 is a schematic side sectional view of a well undergoing drilling in accordance with a further alternate embodiment of the present invention.

A further embodiment of the invention is represented schematically in FIG. 6. In this embodiment first string or tubular member 7, having an inner annulus 8, extends from the surface into the well in a manner similar to the previously described embodiments. However, rather than utilizing a second string or tubular member that is positioned about the first string, the second string is instead comprised of a pipe or conduit 17 that extends into the well without encompassing the first string. As such, in this embodiment outer annulus 11 comprises the internal passageway within pipe 17 and second annulus 10 is defined by the outer surfaces of first string 7 and pipe 17 and the interior surface of well casing 6. As indicated in FIG. 6, pipe 17 is preferably retained in place along the interior surface of well casing 6 through the use of a series of clamps, straps, or connecting members 18. The lower end 19 of pipe 17 may be connected to a circulating collar 23 that would typically form part of, or be integrated into, well casing 6. Circulating collar 23 preferably includes an internal chamber 20 to which annulus 11 of pipe 17 is connected. One or more orifices 21 provide a passageway between chamber 20 and second annulus 10. Accordingly, fluid pumped downwardly through annulus 11 in pipe 17 will be forced into internal chamber 20 and injected through orifices 21 into second annulus 10. By way of a variation to the embodiment shown in FIG. 6, the lower end 19 of pipe 17 may terminate directly within second annulus 10 such that fluid pumped though the pipe is injected directly into the second annulus without the need or use of a circulating collar. In addition, it will be appreciate that other means of injecting and distributing the additional fluid pumped through pipe 17 into second annulus 10 may be utilized, including the use of a plurality of separate pipes 17 spaced about the internal surface of well casing 6. Once again for illustration purposes neither downhole motor 3 nor drill bit 4 have been shown in FIG. 6.

Figure 7:
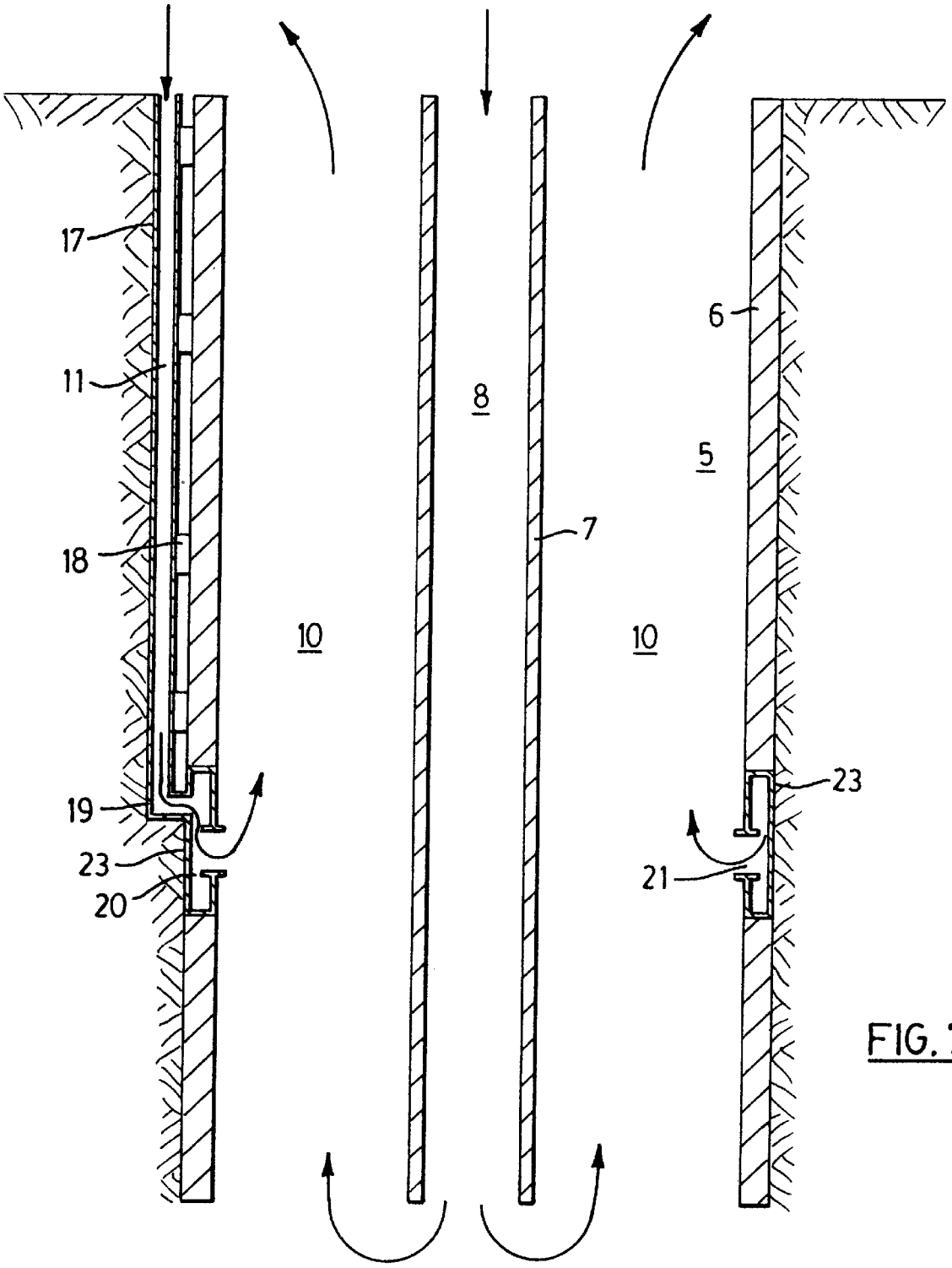

In FIG. 7 there is represented a further alternate embodiment which is similar to that shown in FIG. 6 and as described above. However, in this embodiment pipe 17 is situated outside well casing 6 and would typically be cemented in place with the casing. Accordingly, in FIG. 7 second annulus 10 will be formed between the outer surface of first string 7 and the inner surface of well casing 6. Except for the position of pipe 17, the embodiment depicted in FIG. 7 is essentially the same in structure and method of operation as that shown in FIG. 6. The embodiment of FIG. 7 presents certain advantages over that of FIG. 6 as it allows for pipe 17 to be removed from the stream of drilling returns exiting the well. Those returns may be corrosive and/or abrasive and may erode pipe 17 if it is positioned within the casing. Furthermore, placing pipe 17 outside well casing 6 removes the possibility of the pipe being damaged through contact with first string 7.

The utilization of the above described method, together with properly designed surface equipment, makes it possible to drill over pressured formations without the use of complex high density weighted drilling muds and without the disadvantages that are associated with such muds. The method is particularly adaptable to high pressure gas wells and allows high pressure hydrocarbon zones to be drilled with closer tolerances and with more immediate and consistent pressure control. The described method provides for the addition of required pressure dynamically through a circulation system that permits adjustment in the friction pressure realized within the annulus of returns that are pumped out of the well. Pressure requirements may also be satisfied through adjusting surface back pressure.

The described method also provides the ability to utilize a clear brine (ie: low-solids fluid) for drilling. In many drilling environments the high pressures that are encountered have necessitated the use of drilling muds having weights of from 9 to 20 pounds per gallon. The use of brines was either not possible or required the addition of salt systems that are costly, environmentally unfriendly, and/or highly corrosive. However, when utilizing the above method, and upon a proper design of drilling components and well geometry, more cost effective and less corrosive brine systems may be employed that would otherwise lack sufficient density for use in a high pressure well. A variety of other relatively light liquids, including water and oil, may also be utilized in some applications as the loss of hydrostatic head through the use of a lighter drilling fluid is offset by the increased friction pressure in the returns. In some instances the formation and well characteristics may even permit the use of a zero solids fluid. Brine or low-solid drilling fluids allow for easier, faster and more predictable pressure control, while enhancing the separation of the solid, liquid and gas phases at the surface. As opposed to heavy, high density drilling muds, brines and low-solid lighter fluids serve to optimize drilling performance and reduce the types of formation damage associated with heavy drilling fluids. The embodiment of the invention as depicted in FIGS. 1 and 2 provides the further benefit of allowing for the variation or maintenance of bottom hole circulation pressure during interruptions in drilling fluid circulation (for example when making connections).

As eluded to above, yet a further advantage of this new drilling technique is realized when a "kick" is taken. A kick is defined generally as an influx of fluid from the formation that occurs when the circulating pressure adjacent to the formation is lower than the pour pressure of the formation. The fluid that flows from the formation into the well may be in the form of a liquid, a gas, or a combination of both. In general a gas kick can be more troublesome from a well control perspective as a volume of gas driven into the annulus of returns exiting the well tends to expand upon rising to the surface. When the gas expands it displaces the drilling fluid and serves to further reduce the bottom hole circulating pressure unless well control procedures are very quickly undertaken.

Through the use of the described method there will be in place surface and circulation equipment that will provide a means to adjust the circulation rate to control the bottom hole circulating pressure required in the event of the onslaught of a kick. The kick can be circulated out safely, efficiently, and without the need to alter the density of the drilling fluid. Well control can be controlled merely by increasing the rate that fluid is pumped into outer annulus 11 and into second annulus 10. Once the kick subsides and the influx of fluid from the reservoir ceases the rate of the addition of fluid to second annulus 10 can be decreased to prevent achieving a significantly overbalanced condition that may result in loss of circulation, and potentially stimulate a further gas kick. Surface back pressure systems may also be employed to circulate out the kick, however, considerably higher surface pressures would be generally encountered and the system must be designed to handle such pressures.

As shown, without having to adjust the circulation rate or the density of the drilling fluid to control bottom hole circulating pressure, this unique method carries with it a wide variety of advantages over prior existing methods. Not the least of these advantages is the ability to more safely and effectively drill over pressurized formations that would otherwise present challenging and potentially dangerous situations. In these regards the method presents a means to safely drill over pressurized formations in a balanced or over-balanced state. In addition, it will be appreciated that the described method could also be used for under-balanced drilling of high pressure wells in order to reduce and control surface pressures to the extent that conventional rotating heads can be utilized.

It is to be understood that what has been described are the preferred embodiments of the invention and that it may be possible to make variations to these embodiments while staying within the broad scope of the invention. Some of these variations have been discussed while others will be readily apparent to those skilled in the art. For example, while vertical wells are shown in the attached drawings the described method could also be applied to directional or horizontal wells.

We claim:

1. A method of drilling a well through an underground formation, the method comprising the steps of:

with a drill bit drilling a borehole from a location near the surface into the earth;

using a first string to define an inner annulus within said borehole, said inner annulus running from the surface to a point proximate the bottom of said borehole;

positioning a second string within the borehole about said first string and thereby defining a second annulus between the interior of said second string and the exterior of said first string, thereby also defining an outer annulus exterior to said second string;

providing a connecting passageway between said outer annulus and said second annulus at a point uphole from the bottom of said first string, said outer annulus sealed at a point downhole of said connecting passageway such that fluid entering said outer annulus is prevented from escaping into the bottom of the well and is directed through said connecting passageway;

providing a supply of pressurized drilling fluid to the drill bit by pumping said drilling fluid through said inner annulus, said drilling fluid flushing cuttings produced by said drill bit through said second annulus and exiting out of said well in the form of drilling fluid returns; and, providing a supply of pressurized fluid to said second annulus by pumping said fluid into said outer annulus and forcing said fluid into said second annulus through said connecting passageway, said fluid forced into said second annulus increasing the friction of said returns flowing through said second annulus resulting in an increase in friction pressure within said second annulus and thereby increasing the bottom hole circulating pressure in the well.

2. The method as claimed in claim 1 including the further step of maintaining the bottom hole circulating pressure in the well within defined limits through monitoring downhole fluid pressure proximate the bottom of the well and controlling the volume and pressure of fluid pumped into said outer annulus in response to fluctuations in the downhole fluid pressure.

3. The method as claimed in claim 2 wherein said step of maintaining the bottom hole circulating pressure in the well within defined limits includes increasing the friction pressure within said second annulus through increasing the rate of pumping of said fluid into said outer annulus upon a decrease in the pressure of the downhole fluid pressure proximate the bottom of the well, and decreasing the friction pressure within said second annulus through decreasing the rate of pumping of said fluid into said outer annulus upon an increase in the downhole fluid pressure proximate the bottom of the well.

4. The method as claimed in claim 1 including the further step of maintaining the bottom hole circulating pressure in the well within defined limits through monitoring the pressure of said returns within said second annulus and controlling the volume and pressure of fluid pumped into said outer annulus in response to fluctuations in the pressure of said returns in said second annulus.

5. The method as claimed in claim 4 wherein said step of maintaining the bottom hole circulating pressure in the well within defined limits includes increasing the friction pressure within said second annulus through increasing the rate of pumping of said fluid into said outer annulus upon an increase in the pressure of said returns in said second annulus, and decreasing the friction pressure within said second annulus through decreasing the rate of pumping of said fluid into said outer annulus upon a decrease in the pressure of said returns in said second annulus.

6. The method as claimed in claim 5 wherein said pressurized drilling fluid supplied through said inner annulus and said pressurized fluid pumped through said outer annulus are of the same composition.

7. The method as claimed in claim 1 including the step of encasing the borehole and thereby defining said outer annulus between the exterior of said second string and the interior of said casing.

8. The method as claimed in claim 1 wherein said underground formation is a high pressure hydrocarbon formation and including the step of maintaining the well in a controlled pressure state.

9. A method of drilling an encased well into a high pressure underground hydrocarbon formation utilizing a drill bit to drill a borehole from a location near the surface into the underground formation, the method comprising the steps of:

with a first string situated within the borehole, defining an inner annulus running from the surface to a point proximate the bottom of the borehole;

placing a second string within the borehole about said first string thereby defining a second annulus between the interior of said second string and the exterior of said first string, thereby also defining an outer annulus between the exterior of said second string and the interior of the well casing;

providing a connecting passageway between said outer annulus and said second annulus at a point uphole from the bottom of said first string;

providing a supply of pressurized drilling fluid to the drill bit by pumping said drilling fluid through said inner annulus, said drilling fluid flushing cuttings produced by said rotary bit through said second annulus, said drilling fluid and said cuttings in said second annulus comprising drilling fluid returns;

providing a supply of pressurized fluid to said second annulus by pumping said fluid into said outer annulus and forcing said fluid into said second annulus through said connecting passageway; and, maintaining the bottom hole circulating pressure in the well within defined limits through monitoring the pressure of said returns within said second annulus and controlling the volume and pressure of fluid pumped into said outer annulus in response to fluctuations in the pressure of said returns in said second annulus.

10. A method of drilling an encased well into a high pressure underground hydrocarbon formation utilizing a drill bit to drill a borehole from a location near the surface into the underground formation, the method comprising the steps of:

with a first string situated within the borehole, defining an inner annulus running from the surface to a point proximate the bottom of the borehole;

placing a second string within the borehole about said first string thereby defining a second annulus between the interior of said second string and the exterior of said first string, thereby also defining an outer annulus between the exterior of said second string and the interior of the well casing;

providing a connecting passageway between said outer annulus and said second annulus at a point uphole from the bottom of said first string;

providing a supply of pressurized drilling fluid to the drill bit by pumping said drilling fluid through said inner annulus, said drilling fluid flushing cuttings produced by said drill bit through said second annulus, said drilling fluid and said cuttings in said second annulus comprising drilling fluid returns;

providing a supply of pressurized fluid to said second annulus by pumping said fluid into said outer annulus and forcing said fluid into said second annulus through said connecting passageway; and, maintaining the bottom hole circulating pressure in the well within defined limits through monitoring the downhole fluid pressure proximate the bottom of the well and controlling the volume and pressure of fluid pumped into said outer annulus in response to fluctuations in the downhole fluid pressure.

11. A method of drilling a well having a first tubular member extending from the surface of said well to a position proximate the bottom of said well, said first tubular member having an inner annulus, said well also having a second tubular member extending from the surface of said well to a position proximate the bottom of said well, said first and second tubular members forming a second annulus therebetween, said second tubular member and said well forming an outer annulus therebetween, said method comprising:

pumping a first fluid through said inner annulus; and, pumping an additional volume of said first fluid through said outer annulus and into said second annulus to control the circulating pressure while drilling said well.

12. The method as claimed in claim 11 including the further step of maintaining the circulating pressure within defined limits through monitoring downhole fluid pressure proximate the bottom of said well and controlling the volume of fluid pumped into said outer annulus in response to fluctuations in said downhole fluid pressure.

13. The method as claimed in claim 12 including the step of providing a connecting passageway between said outer annulus and said second annulus at a point uphole from the bottom of said first tubular member such that fluid pumped through said outer annulus is directed through said connecting passageway into said second annulus.

14. A method of controlling the bottom hole circulating pressure when drilling a well having first and second tubular members extending from the surface into said well, said well having an inner annulus defined by the interior of said first tubular member, said well having a second annulus defined by the outer surfaces of said first and said second tubular members and the inner surface of said well, said well having an outer annulus defined by the interior of said second tubular member, the method comprising the steps of:

pumping a first fluid through said inner annulus in said first tubular member; and, pumping an additional volume of said first fluid through said outer annulus in said second tubular member and into said second annulus to control the circulating pressure while drilling said well.

15. The method as claimed in claim 14 including the further step of maintaining said bottom hole circulating pressure within defined limits through monitoring downhole fluid pressure proximate the bottom of said well and controlling the volume of fluid pumped into said outer annulus in response to fluctuations in said downhole fluid pressure.

16. The method as claimed in claim 14 including the further step of maintaining said bottom hole circulating pressure within defined limits through monitoring the pressure of drilling returns within said second annulus and controlling the volume of fluid pumped into said outer annulus in response to fluctuations in the pressure of said returns in said second annulus.

17. A method of controlling the bottom hole circulating pressure when drilling a well having first and second tubular members extending from the surface into said well, said second tubular member comprising a double walled pipe, said well having an inner annulus defined by the interior of said first tubular member, said well having a second annulus defined by the outer surfaces of said first and said second tubular members and the inner surface of said well, said well having an outer annulus defined by the interior of said second tubular member, the method comprising the steps of:

pumping a fluid through said inner annulus in said first tubular member; and, pumping a fluid through said outer annulus in said second tubular member and into said second annulus to control the circulating pressure while drilling said well.

18. The method as claimed in claim 17 including the further step of maintaining the circulating pressure within defined limits through monitoring downhole fluid pressure proximate the bottom of said well and controlling the volume of fluid pumped into said outer annulus in response to fluctuations in said downhole fluid pressure.

19. A method of controlling the bottom hole circulating pressure when drilling an encased well having a first tubular member extending from the surface into said well, said well having an inner annulus defined by the interior of said first tubular member, said well having a second annulus defined by the outer surface of said first tubular member and the inner surface of said well, said well having an outer annulus defined by the interior of a second tubular member extending from the surface along the exterior surface of the well casing, said second tubular member intersecting said well casing at a defined position along the length of said well casing and said outer annulus in communication with said second annulus adjacent said point of intersection, the method comprising the steps of:

pumping a fluid through said inner annulus in said first tubular member; and, pumping a fluid through said outer annulus in said second tubular member and into said second annulus to increase friction pressure within said second annulus and to increase bottom hole circulating pressure while drilling said well.

20. A method of controlling the bottom hole circulating pressure when drilling an encased well having a first tubular member extending from the surface into said well, said well having an inner annulus defined by the interior of said first tubular member, said well having a second annulus defined by the outer surface of said first tubular member and the inner surface of said well, said well having an outer annulus defined by the interior of a second tubular member extending from the surface along the exterior surface of the well casing, said second tubular member intersecting said well casing at a defined position along the length of said well casing and said outer annulus in communication with said second annulus adjacent said point of intersection, the method comprising the steps of:

pumping a fluid through said inner annulus in said first tubular member:

pumping a fluid through said outer annulus in said second tubular member and into said second annulus to increase friction pressure within said second annulus and to increase bottom hole circulating pressure while drilling said well: and, maintaining the circulating pressure within defined limits through monitoring downhole fluid pressure proximate the bottom of said well and controlling the volume of fluid pumped through said outer annulus in said second tubular member.

* * * * *